United States Patent [19]

Schmidt

[11] 3,970,157

[45] July 20, 1976

[54] RAM-BORER APPARATUS

[75] Inventor: Paul Schmidt, Lennestadt, Germany

[73] Assignee: Tracto-Technik, Lennestadt, Germany

[22] Filed: July 30, 1973

[21] Appl. No.: 384,069

[30] Foreign Application Priority Data

Aug. 30, 1972 Germany ..... 2242605

[52] U.S. Cl. ..... 175/22; 61/72.7; 285/305; 175/73; 173/131

[51] Int. Cl.[2] ..... E21B 11/02; F16L 1/02

[58] Field of Search ..... 175/26, 73, 91, 97, 175/19–23, 325; 173/91, 139, 131; 285/305; 61/72.7

[56] References Cited

UNITED STATES PATENTS

| | | | |
|---|---|---|---|
| 2,750,210 | 6/1956 | Trogdon et al. | 285/305 X |
| 3,321,033 | 5/1967 | Benuska et al. | 173/139 |
| 3,375,885 | 4/1968 | Scott et al. | 175/26 |
| 3,407,884 | 10/1968 | Zygmunt et al. | 173/91 |
| 3,474,873 | 10/1969 | Zygmunt | 175/19 |
| 3,569,912 | 3/1971 | Damm | 285/305 X |
| 3,794,128 | 2/1974 | Gagen et al. | 175/19 |
| 3,797,586 | 3/1974 | Coyne et al. | 175/19 |
| 3,805,899 | 4/1974 | Hicks et al. | 175/19 |

*Primary Examiner*—Ernest R. Purser
*Assistant Examiner*—Richard E. Favreau
*Attorney, Agent, or Firm*—Toren, McGeady and Stanger

[57] ABSTRACT

A ram-borer apparatus is described which comprises a tubular housing, a percussion piston which is movable axially to and fro in the housing, and a striker-tip which is arranged to slide in an axial direction relative to the housing and which bears against the housing in the working direction via a resilient member. In accordance with the invention, there is attached to the rear end of the housing a drag-sock for coupling a tube or cable, etc. to the housing, and/or an expander-cone for enlarging the bore formed by the apparatus, and/or a steering tube for steering the apparatus along a straight or preselected arcuate path.

5 Claims, 8 Drawing Figures

RAM-BORER APPARATUS

Figure 1:
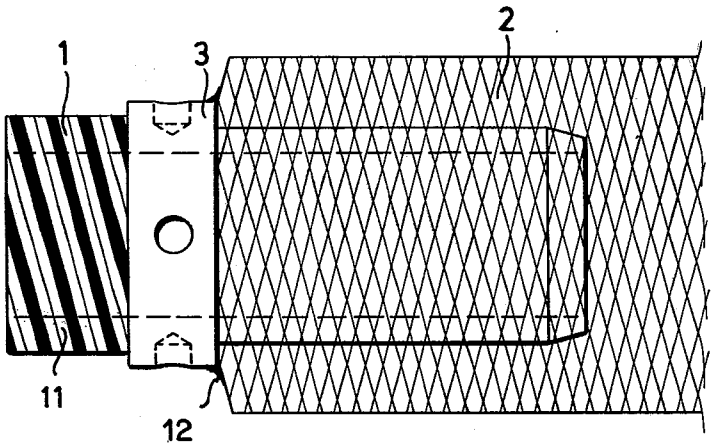

The invention relates to a self-driven ram-borer apparatus, especially for earth-boring, of the type comprising a tubular housing, a percussion piston movable axially to and fro in the housing, and a striker-tip arranged to slide in an axial direction relative to the housing and bearing against the housing in the working direction via a resilient member, in accordance with co-pending patent application Ser. No. 307,573, filed Nov. 17, 1972.

Due to their special striker-tips, ram-borer apparatus of the abovementioned kind require a smaller impact energy, compared with conventional ram-borer apparatus, for equal thrust power. Hence, the associated percussion piston can have a correspondingly smaller piston area and hence, besides the economy of driving power, a considerable reduction in the diameter of the housing is possible. Further, due to the special arrangement of the striker-tip, the housing experiences a very much smaller loading than the housing of a comparable conventional ram-borer apparatus.

An object of the present invention is to improve further the ram-borer apparatus of the abovementioned patent application, by providing additional facilities.

Such facilities are provided, in accordance with the invention, by the attachment, on the tubular housing, of a drag-sock and/or at the rear end an expander-cone and/or a steering tube.

The drag-sock consists preferably of a steel wire braid which is plaited diagonally to its longitudinal direction so that the drag-sock expands under axial pressure and contracts under axial tension. In the expanded condition of the drag-sock, a tube or cable which is to be laid by the ram-borer apparatus is pushed into the drag-sock. By pulling on the drag-sock and the tube or cable, and thereby contracting the drag-sock, the tube or cable is firmly connected to the apparatus, irrespective of the diameter of the tube or cable and the ratio of this to the diameter of the housing of the ram-borer apparatus. The drag-sock thereby forms a coupling by which the tube or cable, within a wide range of diameters, can be coupled to the ram-borer apparatus. Furthermore, the use of a drag-sock avoids the need for special preparation of the tube or cable to be laid, such as the cutting of a thread in it, for attachment to the apparatus.

The drag-sock itself can be provided, at the end adjacent the housing, with a threaded nipple by which it is screwed on to a corresponding external thread on the housing.

To facilitate the laying operation, it is advantageous if the ram-borer apparatus has an expander-cone which expands the bore in the earth sufficiently wide for the tube or cable being laid to move in the bore in the earth without any substantial friction. Moreover, particularly favourable conditions arise if the expander-cone is arranged at the rear end of the housing of the ram-borer apparatus and the cone is made slender.

As another feature of the invention, straying of the ram-borer apparatus out of the required direction during advance may be substantially obviated by a steering-tube attached to the back end of the housing of the ram-borer appartus. The steering tube ensures that the ram-borer apparatus itself, when penetrating voids or wet ground, or when butting against rocks, maintains its required direction. In particular, a direction-stabilising straight tube serves this purpose, which tube, in effect, elongates the housing of the ram-borer apparatus. Alternatively, a curved tube may be used which forces even a straight ram-borer apparatus housing on to a curved path. In the latter case the steering-tube preferably also has guide surfaces such as, for example, steering-wings.

Figure 2:
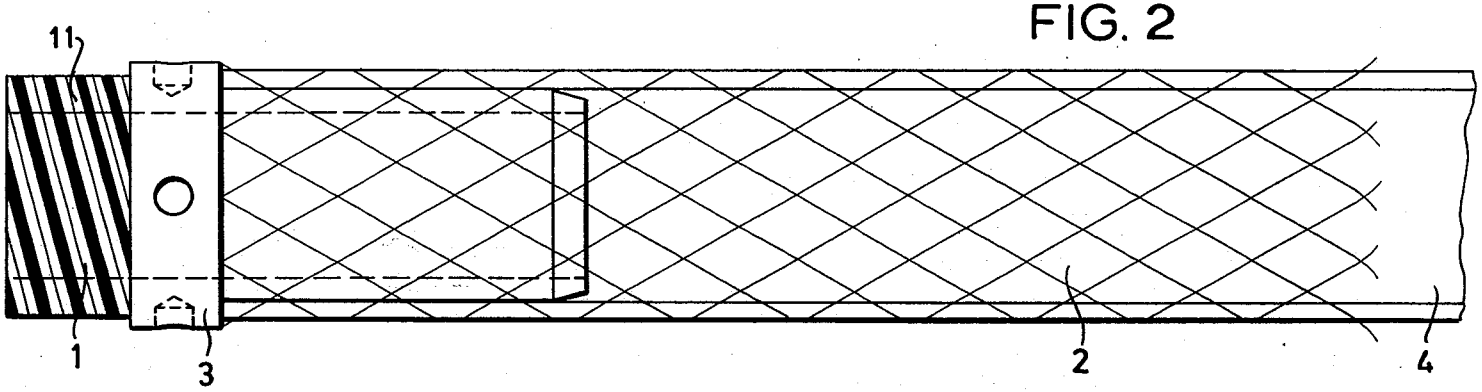
Figure 3:
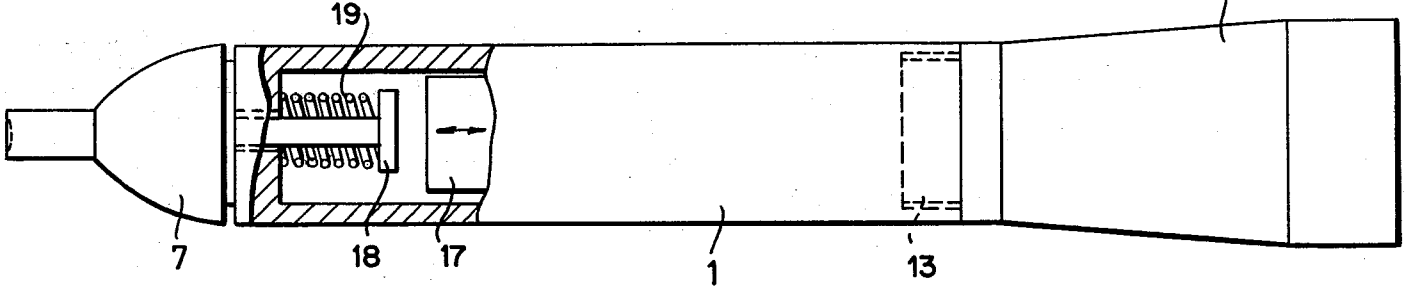
Figure 4:
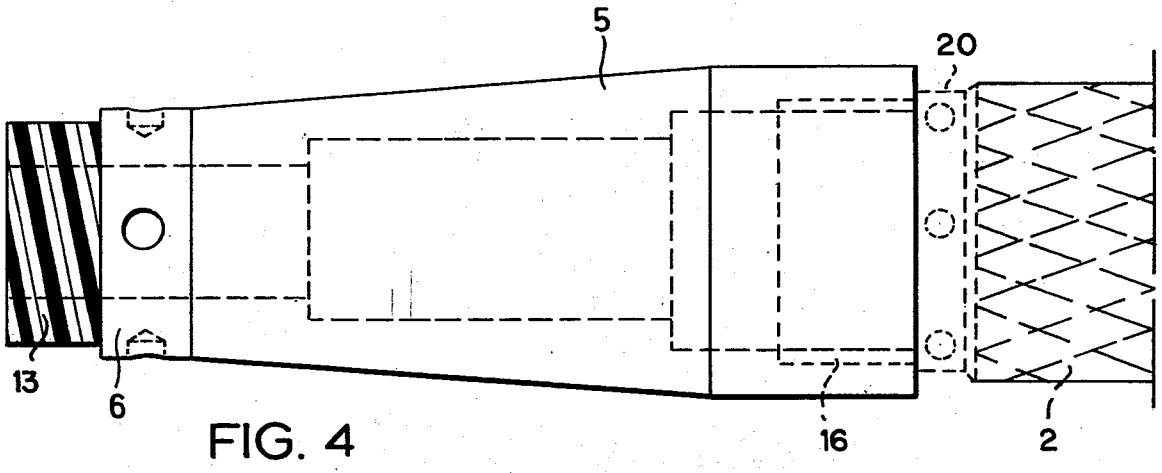
Figure 5:
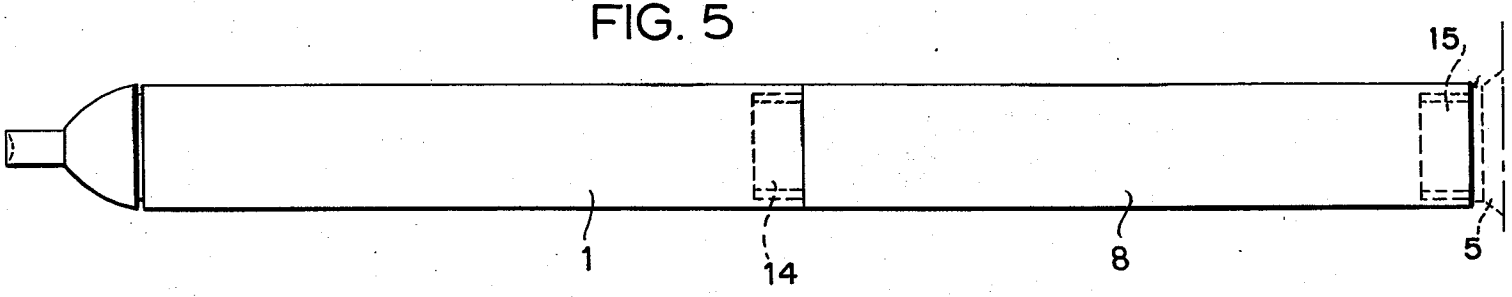
Figure 6:
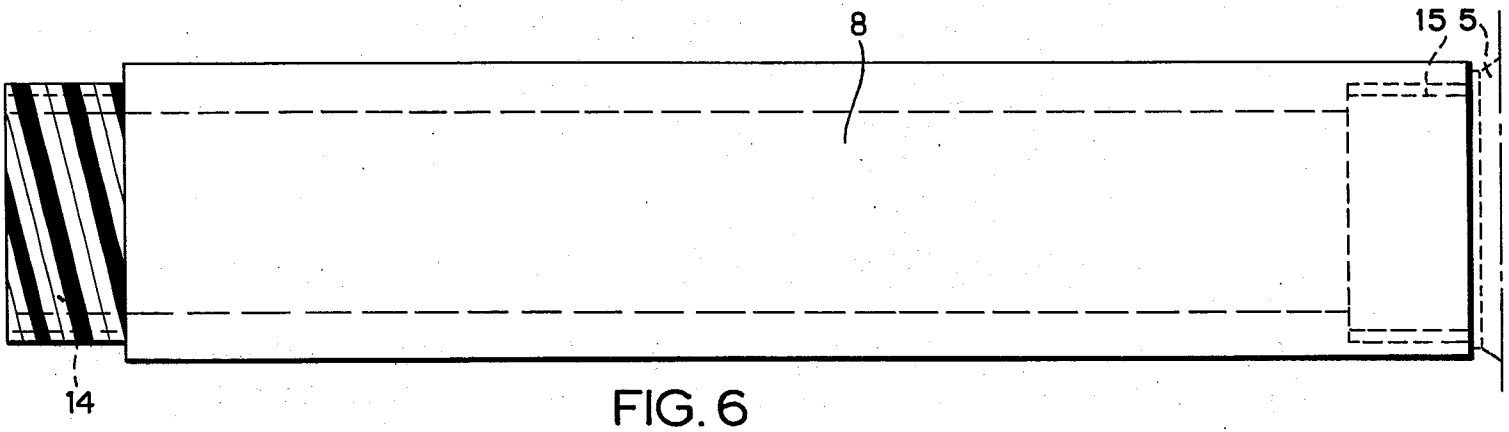
Figure 7:
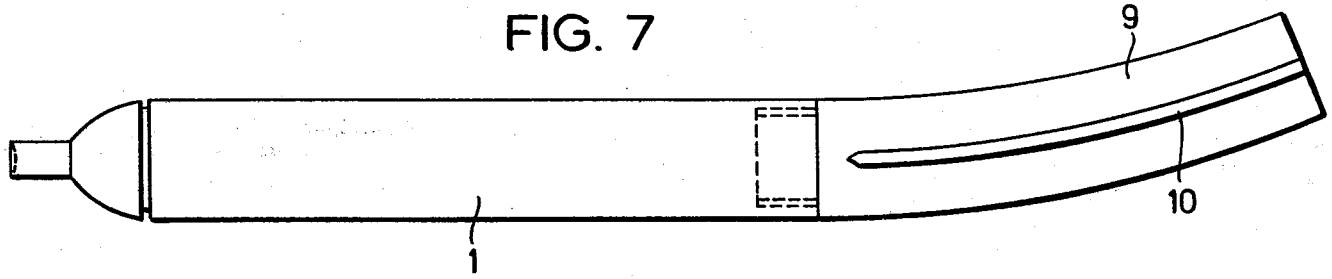
Figure 8:
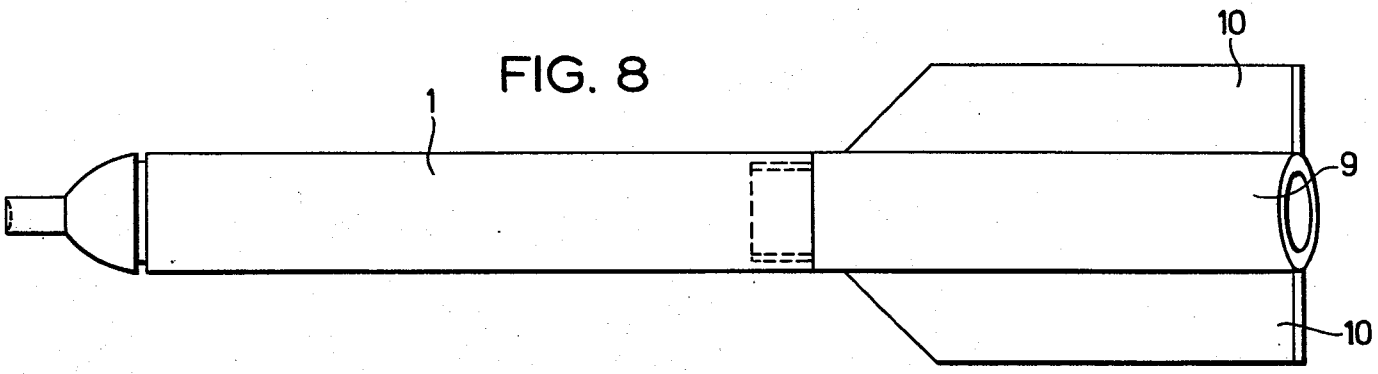

Embodiments of the invention will now be described, by way of example, with reference to the accompanying drawings, in which:

FIGS. 1 and 2 are side views of part of a ram-borer apparatus with a drag-sock attached thereto, the drag-sock being, respectively, diametrically expanded and contracted, FIG. 3 is a side elevation of a ram-borer apparatus with an expander-cone arranged at the rear end of the housing of the apparatus, FIG. 4 is an enlarged side elevation of an alternative expander-cone, FIG. 5 is a side elevation of a ram-borer apparatus with a straight steering-tube, FIG. 6 is a side elevation of the steering-tube, on an enlarged scale, and FIGS. 7 and 8 are a side elevation and plan, respectively, of a ram-borer apparatus with a curved steering-tube.

Referring to FIGS. 1 and 2 of the drawings, a ram-borer apparatus 1 is provided with a stub and an external thread 11 at the rear end of its housing. On the external thread is seated a threaded nipple 3 to which is attached a drag-sock 2, for example by weld 12. The threaded nipple 3 has holes uniformly distributed round its circumference for a C-spanner. The drag-sock 2 consists of a steel wire braid plaited diagonally to its longitudinal direction, so that under pressure it expands diametrically in the manner shown in FIG. 1 and under tension it contracts as shown in FIG. 2. When the drag-sock is in the expanded state, a tube 4 to be laid by the ram-borer apparatus is pushed into the drag-sock and on to the stub on the housing. The drag-sock is then elongated so that it lies in contact with the tube 4. Then by pulling the drag-sock 2 and the tube 4 away from one another the latter is seated firmly on the stub, i.e. the drag-sock 2 closes firmly round the tube 4 as a coupling between the ram-borer apparatus and the tube 4. During the advancing of the ram-borer apparatus in the ground, the drag-sock 2 thus takes the tube 4 with it. The drag-sock 2 can also be employed independently of the stub on the housing of the ram-borer apparatus and is then suitable for tubes 4 of different diameters.

FIG. 3 shows in partial section an assembly in accordance with the present invention wherein a pneumatic percussion piston 17 is arranged for reciprocal motion within the housing in the direction of the arrow with the piston striking at its forward end against a rear stop 18 of the percussion or striker tip 7 thereby imparting its kinetic energy in an undamped manner to the tip 7. The resulting shock load is only partially transmitted to the housing and is highly damped, and in this connection the stop 18 is arranged to bear against the housing through the medium of a spring element 19.

Referring to FIGS. 3 and 4 of the drawings, the advancing of the ram-borer apparatus is, if desired, facilitated by an expander-cone 5 arranged at the rear end of the housing. The expander-cone 5 is either screwed into the rear end of the housing by an appropriate threaded stub 13 as in FIG. 3 or is screwed on to an external thread on the rear end of the housing by a threaded nipple 6 as in FIG. 4. Furthermore, the expander-cone 5 has at its rear end a threaded connection 16 for a tube which is to be laid, and/or a drag-sock 2, which is shown in dashed line in FIG. 4. The drag-sock 2 may have attached to its front end a threaded nipple 20 and, as shown in FIG. 4, it is attached to the rear end of the expander cone 5 by means of the threaded connection 16, with the expander cone 5 being, in turn, attached to the rear end of the borer apparatus by the threaded stub 13. Due to its slender shape broadening outwards, the expander-cone, during the advancing of the ram-borer apparatus, expands the bore in the ground produced by the striker-tip 7 and the housing of the apparatus, so that the friction between the tube and/or the drag-sock lying behind the ram-borer apparatus and the wall of the bore formed in the earth is considerably reduced.

Instead of the expander-cone 5, or in addition to the expander cone 5, which is shown in dashed lines in FIGS. 5 and 6, a straight steering-tube 8 can, as shown in FIGS. 5 and 6, be screwed to the ram-borer apparatus 1. The steering-tube 8 elongates the guiding length of the ram-borer apparatus in the ground and thereby acts upon the ram-borer apparatus to stabilise its direction. In order that it can be screwed on, the steering-tube 8 is provided at the front end with a threaded stub 14. At the rear end it has a connector thread 15 for an expander-cone and/or for a tube which is to be laid and/or for a drag-sock.

The steering-tube can, however, act not only to stabilise the direction but also to change the direction of the bore. For changing the direction of the bore, a steering-tube 9, as shown in FIGS. 7 and 8, is curved and if desired may, at the same time, be provided with steering-wings 10 which are curved in like manner. If a curved steering-tube 9 with steering-wings 10 is fitted on to the rear end of the housing of the ram-borer apparatus 1, the bore formed in the earth by the ram-borer apparatus runs in an arc which is dependent upon the curvature of the steering-tube 9 and the steering-wings 10.

As best seen in FIGS. 1 and 4, the drag-sock 2 is made with one end, i.e., its attachment end at which the nipple 3 or 20 is connected, approximately equivalent in diameter with the outer diameter of the member to which it is attached, i.e., the ram-borer 1 or the expansion cone 5, thereby to reduce the friction between the ram-borer apparatus and the ground opening through which it moves.

We claim:

1. A self-propelled pneumatic ram-borer apparatus, particularly suitable for effecting trial borings, comprising, in combination, a tubular housing having a forward end and a rearward end, a percussion piston reciprocally movable within said housing, a percussion tip arranged in said housing for axial displacement therein, said percussion tip being disposed to receive impact forces from said percussion piston to effect said trial borings and to bear against said housing, a resilient member interposed between said percussion tip and said housing through which said percussion tip bears against said housing, and a braided metallic drag-sock having an end connected to said tubular housing at the rearward end thereof and adapted to engage about a tube to be drawn through said trial borings, with said end of said drag-sock connected to said housing having an outer diameter which is approximately equivalent to the outer diameter of said tubular housing.

2. Apparatus according to claim 1 wherein said drag-sock comprises a threaded connecting fitting.

3. A self-propelled pneumatic ram-borer apparatus, particularly suitable for effecting trial borings, comprising, in combination, a tubular housing having a forward end and a rearward end, a percussion piston reciprocally movable within said housing, a percussion tip arranged in said housing for axial displacement therein, said percussion tip being disposed to receive impact forces from said percussion piston to effect said trial borings and to bear against said housing, a resilient member interposed between said percussion tip and said housing through which said percussion tip bears against said housing, an expander-cone having a generally conical configuration defining a smaller diameter forward end and a larger diameter rearward end, said expander cone being connected to said tubular housing with said forward end attached to said rearward end of said housing, and a braided metallic drag-sock having an end connected to said rearward end of said expander cone and adapted to engage a tube to be drawn through said trial borings, said end of said drag-sock connected to said rearward end of said expander cone having an outer diameter which is approximately equivalent to the outer diameter of said rearward end of said expander cone.

4. A self-propelled pneumatic ram-borer apparatus, particularly suitable for effecting trial borings, comprising, in combination, a tubular housing having a forward end and a rearward end, a percussion piston reciprocally movable within said housing, a percussion tip arranged in said housing for axial displacement therein, said percussion tip being disposed to receive impact forces from said percussion piston to effect said trial borings and to bear against said housing, a resilient member interposed between said percussion tip and said housing through which said percussion tip bears against said housing, a steering tube in the form of a tubular member connected to said rearward end of said housing, said steering tube having guide surfaces adapted to the desired thrust direction and comprising a curved configuration, an expander cone connected to the rear end of said steering tube, and a braided metallic drag-sock connected to the rear end of said expander cone and adapted to engage a tube to be drawn through said trial borings.

5. Apparatus according to claim 4 wherein said guide surfaces essentially consist of steering wings affixed to said steering tube.

* * * * *

UNITED STATES PATENT OFFICE

CERTIFICATE OF CORRECTION

Patent No. 3970157 Dated July 20, 1976

Inventor(s) Paul Schmidt

It is certified that error appears in the above-identified patent and that said Letters Patent are hereby corrected as shown below:

In the heading of the Patent [73] should read as follows:

--[73] Assignee: Tracto Technik Paul Schmidt, Lennestadt, Germany--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*